US009775757B1

(12) United States Patent
Borgman et al.

(10) Patent No.: US 9,775,757 B1
(45) Date of Patent: Oct. 3, 2017

(54) LIFT CHAIR AND SEAT

(71) Applicant: Hickory Springs Manufacturing Company, Hickory, NC (US)

(72) Inventors: Douglas Borgman, Brookville, IN (US); John Miller, Brookville, IN (US); Jeffrey Weisenbach, Batesville, IN (US); Kenneth Kramer, Greensburg, IN (US); Catherine Wagner, Osgood, IN (US); Michael Verkley, Cedar Grove, IN (US)

(73) Assignee: RFS INNOVATION LLC, Brookville, IN (US)

( * ) Notice: Subject to any disclaimer, the term of this patent is extended or adjusted under 35 U.S.C. 154(b) by 0 days.

(21) Appl. No.: 14/671,153

(22) Filed: Mar. 27, 2015

Related U.S. Application Data

(60) Provisional application No. 61/972,021, filed on Mar. 28, 2014.

(51) Int. Cl.

| | |
|---|---|
| ***A61G 5/14*** | (2006.01) |
| ***A47C 7/50*** | (2006.01) |
| ***A47C 7/54*** | (2006.01) |
| ***A47C 7/00*** | (2006.01) |
| *A61G 5/12* | (2006.01) |

(52) U.S. Cl.
CPC ..... *A61G 5/14* (2013.01); *A47C 7/002* (2013.01); *A47C 7/506* (2013.01); *A47C 7/54* (2013.01); *A61G 2005/125* (2013.01); *A61G 2005/127* (2013.01); *A61G 2005/128* (2013.01)

(58) Field of Classification Search
CPC ..... A61G 5/14; A47C 1/031
See application file for complete search history.

(56) References Cited

U.S. PATENT DOCUMENTS

| | | | | |
|---|---|---|---|---|
| 3,138,402 A | | 6/1964 | Heyl et al. | |
| 4,083,599 A | * | 4/1978 | Gaffney | A61G 5/14 248/393 |
| 4,249,774 A | | 2/1981 | Andreasson | |
| 5,062,676 A | * | 11/1991 | Mars | A47C 1/022 297/284.3 |
| 5,346,280 A | * | 9/1994 | Deumite | A61G 5/14 180/907 |
| 5,363,934 A | | 11/1994 | Edmund et al. | |
| 5,907,878 A | | 6/1999 | Thomas et al. | |
| 5,984,411 A | | 11/1999 | Galumbeck | |

(Continued)

FOREIGN PATENT DOCUMENTS

| | | |
|---|---|---|
| EP | 0586765 | 3/1994 |
| GB | 2161371 A | 6/1984 |
| WO | WO 92/14432 | 9/1992 |

*Primary Examiner* — Philip Gabler

(57) ABSTRACT

A lift chair includes a lift mechanism that maintains a continuous seating position during forward and elevated movement by supporting the occupant's seat, arms and back. The mobile section of the chair will also lower the occupant to the normal seating height. The gel cushion seating surface is attached at least to the moveable section of the lift chair. The gel cushion seating surface of the chair has a plurality of gel cushion cylinders arranged in a grid that provide a rhythmically changing support area at multiple points on the occupant's buttocks and thighs. This provides a comforting massage which reduces stress on the body associated with prolonged seating.

15 Claims, 12 Drawing Sheets

(56) References Cited

U.S. PATENT DOCUMENTS

| | | | | |
|---|---|---|---|---|
| 6,213,554 | B1 * | 4/2001 | Marcoux | A61G 5/14 297/330 |
| 6,752,459 | B2 | 6/2004 | Deisig | |
| 7,021,713 | B2 * | 4/2006 | Kao | A61G 5/14 297/338 |
| 7,090,297 | B2 * | 8/2006 | Mohn | A61G 5/14 297/330 |
| 7,134,721 | B2 * | 11/2006 | Robinson | B60N 2/501 297/284.11 |
| 7,434,282 | B2 | 10/2008 | Fraser et al. | |
| 7,681,265 | B2 | 3/2010 | Fraser | |
| 8,414,074 | B2 | 4/2013 | Kramer et al. | |
| 8,434,748 | B1 | 5/2013 | Pearce et al. | |
| 2005/0029846 | A1 * | 2/2005 | Jonas | A47C 1/023 297/284.3 |
| 2008/0296947 | A1 * | 12/2008 | Galumbeck | A61G 5/14 297/326 |
| 2011/0121626 | A1 | 5/2011 | Lipford | |
| 2011/0193383 | A1 * | 8/2011 | Guissin | A47C 1/023 297/284.3 |
| 2012/0001465 | A1 * | 1/2012 | Rinne | A47C 3/20 297/284.3 |
| 2013/0020779 | A1 | 1/2013 | Green et al. | |

* cited by examiner

LIFT CHAIR AND SEAT

CROSS-REFERENCE TO RELATED PATENT APPLICATIONS

The present application claims priority to U.S. provisional patent application Ser. No. 61/972,021, filed Mar. 28, 2014, the disclosure of which is incorporated herein by reference as if set out in full.

FIELD

The disclosed technology pertains to a mechanized seat apparatus with a movable seat.

BACKGROUND

Due to advanced age, certain medical conditions, or other factors, some individuals find it difficult to lower themselves down to a seated position or raise themselves up from a seated position. Home furniture generally is not designed for persons with this difficulty and results in increased physical stress and strain from what is a common daily activity. These individuals also sometimes suffer from conditions that affect the circulatory and/or nervous systems, with the result that being seated for too long can cause health issues.

Specialized furniture is available that can help alleviate the difficulty in sitting and standing, but most conventional mechanisms for such lift furniture operate in such a way that entering and leaving the seat is awkward and involves a dumping motion as the seat moves the user from a seated position to a standing position. Further, such lift chairs shift dramatically from their lifted state to the seated state and require significant front and rear clearance for use. Some options also exist for reducing the strain of prolonged seating on the body, but are primarily passive systems such as specialized cushions, air mattresses, or active "massage" mechanisms.

What is needed, therefore, is an improved seat that can be raised and lowered so that a person can sit or stand without any awkward motions—such as falling back into a seat or being dumped from a seat—and/or that can provide a gentle and unobtrusive variation in the seating surface over time so as to reduce the damage that prolonged sitting can cause the body.

SUMMARY

The technology disclosed herein can be used to build a seating surface that can assist a person with the act of sitting into or standing from a piece of furniture. The technology in other aspects may provide increased comfort and reduce stress on the body while seated. One exemplary embodiment of this technology is a lift chair. This exemplary lift chair has two sections: a stationary section and a movable section. The stationary section rests upon the floor and has a frame to which the motors and mechanisms for lifting the movable section are attached. The stationary section also may have an attached footrest that may be extended to a horizontal position or lowered into a substantially vertical position. The stationary section includes a stationary seating surface, which is a portion of the total seating surface, and which remains stationary as the remainder of the seating surface lifts. The movable section comprises a backrest, a movable seating surface, and at least one armrest located to the left, right, or both sides of the movable seating surface.

The exemplary lift chair has a lift mechanism that is operable to raise the movable surface from a first position to a second position. At the second position, the movable surface is moved to a height from which an occupant can comfortably transition between standing or sitting from the movable seating surface. The lift mechanism comprises a push bar connected to the stationary frame at one end so that it can pivot up and down. The opposite end of the push bar is connected to a point on a first lift bar, such that it can pivot up and down. A motor is attached to the lower end of the push bar and is operable under user control to push the first lift bar from the first position that is nearly parallel to the floor to the second position that is nearly perpendicular to the floor.

In this exemplary embodiment, the first lift bar is connected by a pivot joint to the seat bar with the opposite end connected to the stationary frame by another pivot joint. A second lift bar is connected by a pivot joint to the stationary frame on one end, and the seat bar on the opposite end. As the first lift bar is pushed from a near parallel position to a near perpendicular position, the second lift bar is also raised, such that the seat bar to which the first lift bar and the second lift bar are attached is also raised. The seat bar begins substantially parallel to the floor and remains substantially parallel to the floor both while being raised and when raised to full height. The backrest, armrests, and movable seating surface all raise with the seat bar. The push bar motor is operable by a controller to raise and lower the seat bar.

An exemplary lift chair has at least one seating surface comprising a plurality of gel cushion cylinders arranged in a grid. The gel cushion cylinders are linked in two or more groups by two or more link bars underneath the grid. Each end of the two or more link bars terminates with a worm gear that engages a worm screw rotating drive. As the worm screw rotates, the cam attached to the link bar rotates to a high or low position. When the cam is in a low position, pressure from the user's body and gravitational force will force the cylinder to the low position. As the link bar continues to rotate, the cam gradually rotates to drive the cylinder back to the high position. In this embodiment, each cam may be rotated in four 90 degree increments on the link bar, though other embodiments use more or fewer increments. In one embodiment, three of the positions are high and one position is low. By arranging each cylinder cam in one of the four positions, a plethora of combinations are created. By turning the rods, the seating surface gradually changes the points on the user's body that are bearing more and less weight as the drive cylinders rotate to simulate the user moving about in the seat to find comfortable positions.

Similarly, other methods, machines, systems, and articles of manufacture could also be implemented based on this disclosure by those of ordinary skill in the art without undue experimentation, and so the preceding summary, as well as the descriptions and drawings set forth herein, should be understood as being illustrative only, and not limiting.

BRIEF DESCRIPTION OF THE DRAWINGS

The drawings and detailed description that follow are intended to be merely illustrative and are not intended to limit the scope of the invention as contemplated by the inventors.

DETAILED DESCRIPTION

The inventors have conceived of novel technology which, for the purpose of illustration, is disclosed herein as applied in the context of a lift chair. In one aspect, the lift chair may be provided with a gel cushion seating surface or with a foam cushion seating surface. While the disclosed applications of the inventors' technology satisfy a long-felt but unmet need in the art of lift chairs and seats for those with special health and wellness care needs, it should be understood that the inventors' technology is not limited to being implemented in the precise manners or applications set forth herein, but could be implemented in other manners and applications without undue experimentation by those of ordinary skill in the art in light of this disclosure. Accordingly, the examples set forth herein should be understood as being illustrative only, and should not be treated as limiting.

Figure 1:
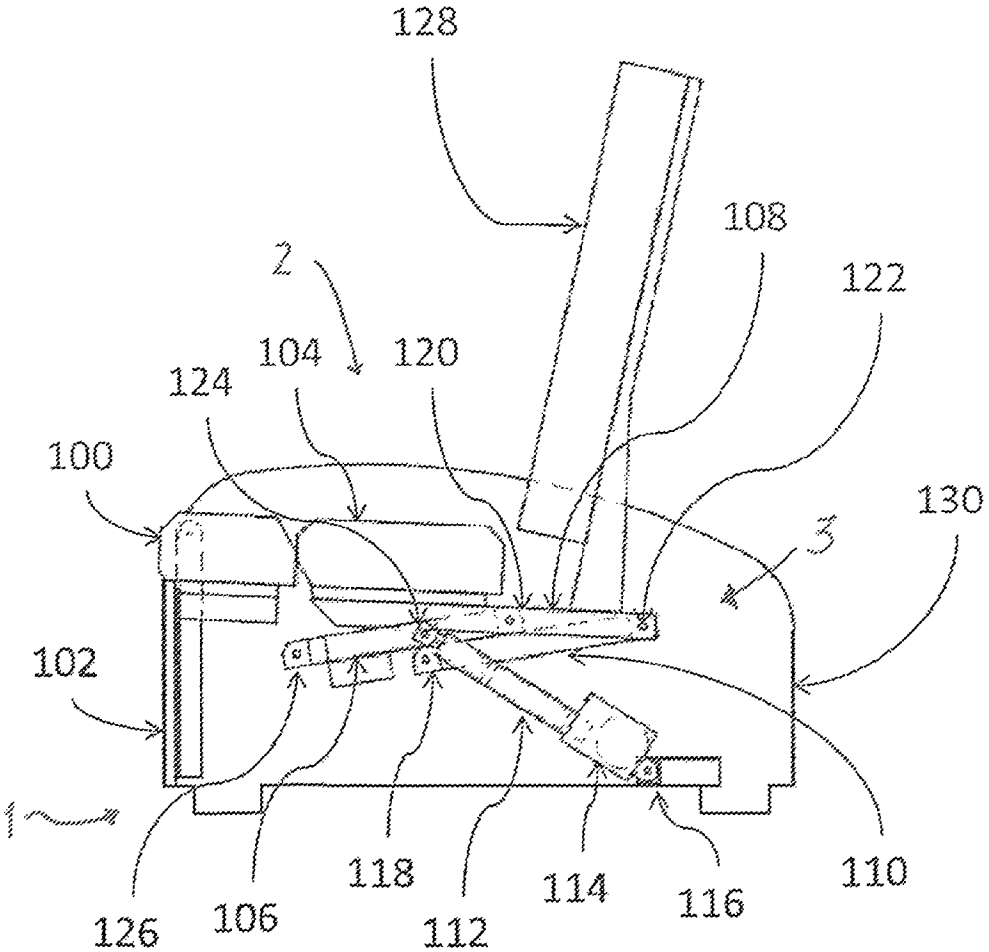
FIG. 1 is a side elevation view of an exemplary lift chair with internal mechanisms exposed and a movable portion in the lowered or first position.

Turning now to the figures, FIG. 1 shows a side elevation view of an exemplary lift chair with internal mechanisms exposed and movable section in the lowered or first position. The lift chair shown has two sections—a stationary section (1) and a movable section (2)—as well as a mechanism (3) for raising and lowering the movable section (2). The two sections are operatively coupled but distinct as will become clear below. The stationary section (1) comprises a stationary frame (130) that rests on the floor. In certain exemplary embodiments, mounted toward the front of the stationary frame (130) is a footrest (102) operable to move between a substantially vertical, lowered position (see FIG. 1) to a substantially horizontal, raised position (see FIG. 11). Mounted to the stationary frame (130) is a stationary seat portion (100). The stationary frame (130) and stationary seat portion (100) both remain substantially stationary during operation of the lift chair and, in particular, when the movable section (2) of the chair moves.

The movable section (2) of the chair comprises a seat bar (108) having a front portion and a back portion opposite the front portion. The seat bar (108) is operatively coupled to a movable seat portion (104) mounted on the front portion of the seat bar (108) and a backrest (128) mounted to the back portion of the seat bar (108). The movable seat portion (104) is substantially horizontal and the backrest (128) is substantially vertical. While in the lowered position, the movable seat portion (104) will be on approximately the same plane as the stationary seat portion (100) such that they form a single seating surface.

The mechanism (3) is operatively coupled to both the stationary section (1) and the movable section (2) and is provided for raising and lowering the movable section (2) with respect to the stationary section (1). The mechanism (3) comprises a first lift bar (106), a second lift bar (110), and a push bar (112). The first lift bar (106) has a lower end that is attached to the stationary frame (130) by a pivot joint (126) and an upper end that is attached to the seat bar (108) by another pivot joint (120). The second lift bar (110) has a lower end that is attached to the stationary frame (130) by a pivot joint (118) and an upper end that is attached to the seat bar (108) by a pivot joint (122). The first lift bar (106) and the second lift bar (110) are coupled to the seat bar (108) at opposite ends of the seat bar (108) forming three sides of a parallelogram in this exemplary connection. A motor (114) is attached to a lower end of the push bar (112) and is operable to increase and decrease the length of the push bar. The lower end of the push bar (112) is attached to the stationary frame (130) by a pivot joint (116), and it is attached to the first lift bar (106) by a pivot joint (124) at a point between the two ends of the first lift bar (106). The mechanism (3) may be considered structure for a means for lifting the movable section (2).

In a lowered state, the seat bar (108) and movable seat portion (104) are nearly parallel to the floor in the lowered state or first position as shown in FIG. 1. The first lift bar (106) and second lift bar (110) are nearly parallel to the floor as well, although shown slighted angulated with respect to the seat bar (108) and the movable seat portion (104). The push bar (112) connects to the first lift bar (106) in this exemplary embodiment, although the push bar (112) could connect to the second lift bar (110) or the seat bar (108). As the motor (114) is operated, the push bar (112) extends and pushes against the first lift bar (106) causing the first lift bar (106) to pivot forward and up around the pivot joint (126). As the first lift bar (106) pivots up and around the pivot joint (126), the seat bar (108) and movable seat portion (104) both lift forward and upward while maintaining a position that is nearly parallel to the floor. Also, the second lift bar (110) pivots forward and up. The push bar (112) may comprise multiple telescoping sections or types of connections allowing for extension and retraction.

Figure 2:
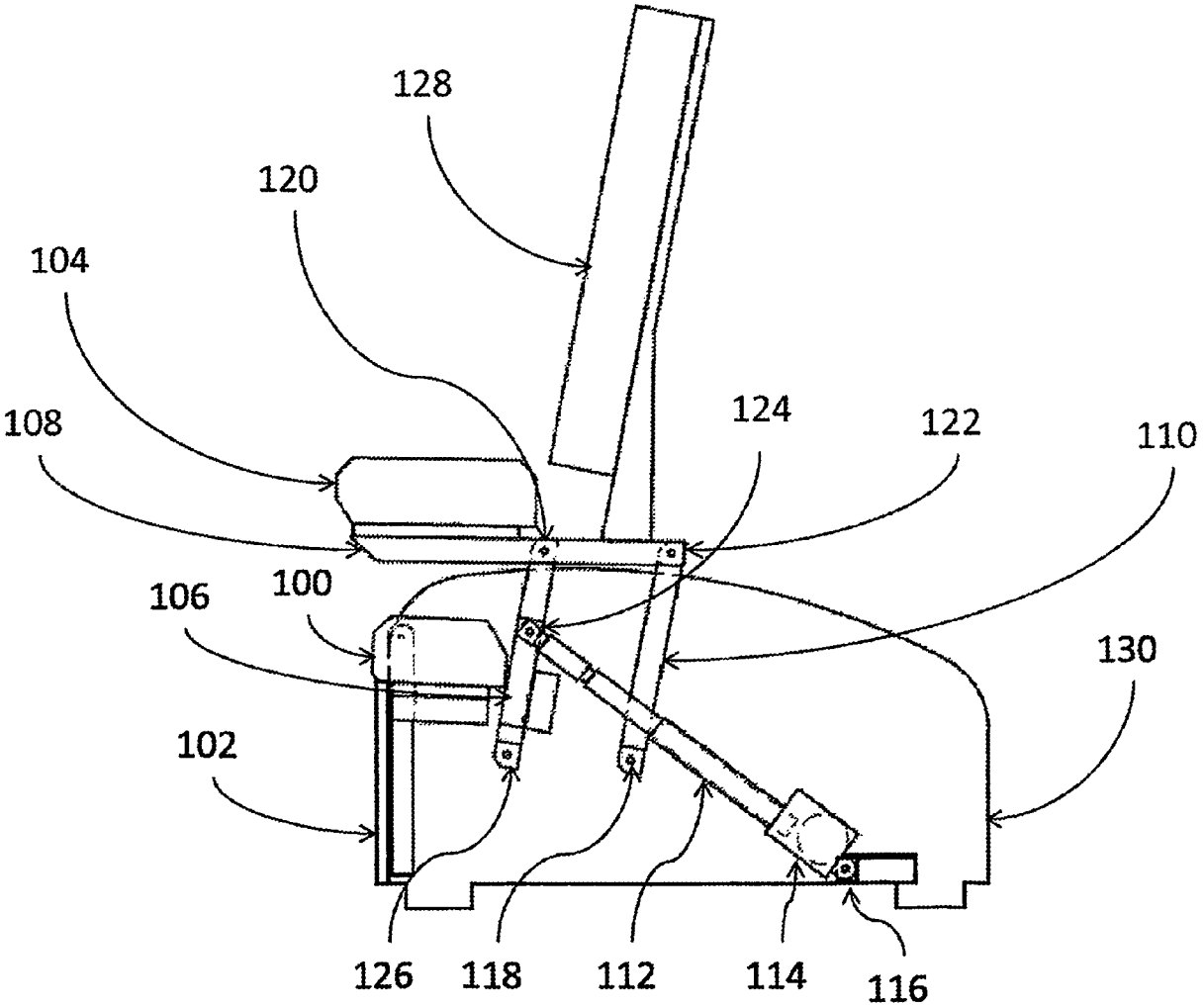
FIG. 2 is a side elevation view of an exemplary lift chair with internal mechanisms exposed and a movable portion in the raised or second position.

FIG. 2 shows a side elevation view of an exemplary lift chair with internal mechanisms exposed and movable section (2) in the raised position or second position. While in the raised position or second position, the first lift bar (106) and the second lift bar (106) are in a position nearly perpendicular to the seat bar (108). The push bar (112) is extended against the first lift bar (106) at the pivot joint (124). The seat bar (108) remains nearly parallel to the floor during movement from the lowered or first position of FIG. 1 to the raised or second position of FIG. 2.

The motor (114) is operable by a controller such that it can be raised and lowered by an occupant during use. One embodiment of the lift chair has two first lift bars (106) and two second lift bars (108) located in-line with each other on each side of the stationary frame (130). The two first lift bars (106) and the two second lift bars (108) may be on opposite sides of the furniture and designated a left first or second lift bar and a right first or second lift bar. In this embodiment, a coupling bar (not specifically shown) spans between the left first lift bar and the right first lift bar and provides a pivot joint connection for the push bar (112). Such a dual lift bar configuration provides increased strength and stability to the mechanism. Adding a third set of first and second lift bars is also possible and might further increase the strength and stability of the mechanism during operation.

In one embodiment, the footrest (102) is connected via a retracting cable to the pivot joint (124) such that, as the push bar (112) extends to its full length, the retracting cable is pulled, causing the footrest (102) to automatically return to the vertical lowered position and allowing an occupant safe ingress and egress from the lift chair. In further embodiments, the lift chair can have armrests attached to the mobile section on each side of the movable seat portion (104) to provide a handhold to an occupant while the movable seat portion (104) is in motion.

In further embodiments, the lift chair can have storage cubbies attached to the movable portion, on either side of the movable seat portion (104), so that items like drinks, medicines, glasses, and mobile phones can be stored by the occupant during operation and retrieved while they are standing or seated. In still further embodiments, the lift chair can have an emergency battery system placed within the stationary frame (130), such that enough power would be available for several operation cycles with no external power supply to the motor (114) in case of a loss of electrical service.

Figure 11:
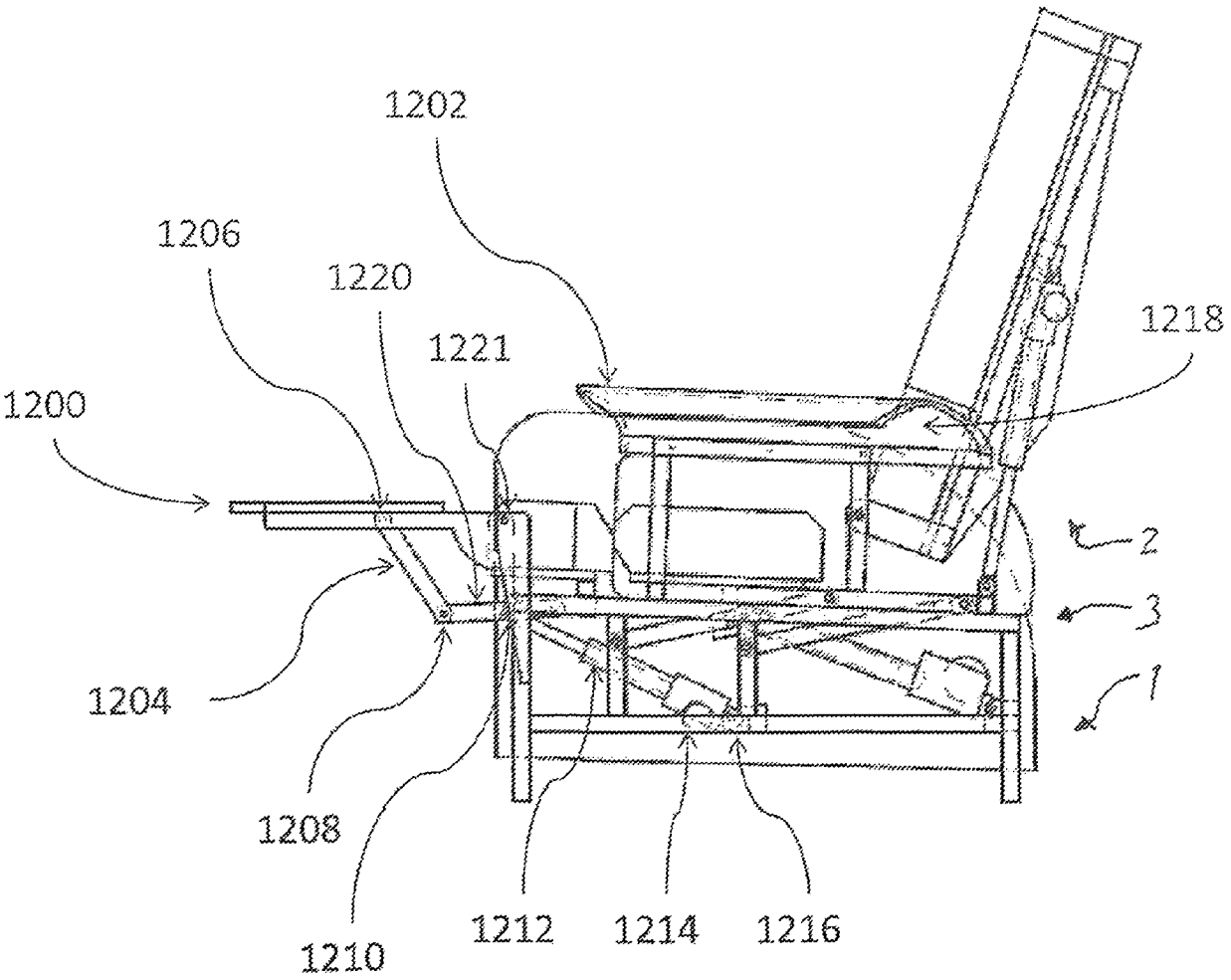
FIG. 11 is a side elevation view of an exemplary lift chair in a lowered position with a hollowed armrest and an electric footrest.
Figure 12:
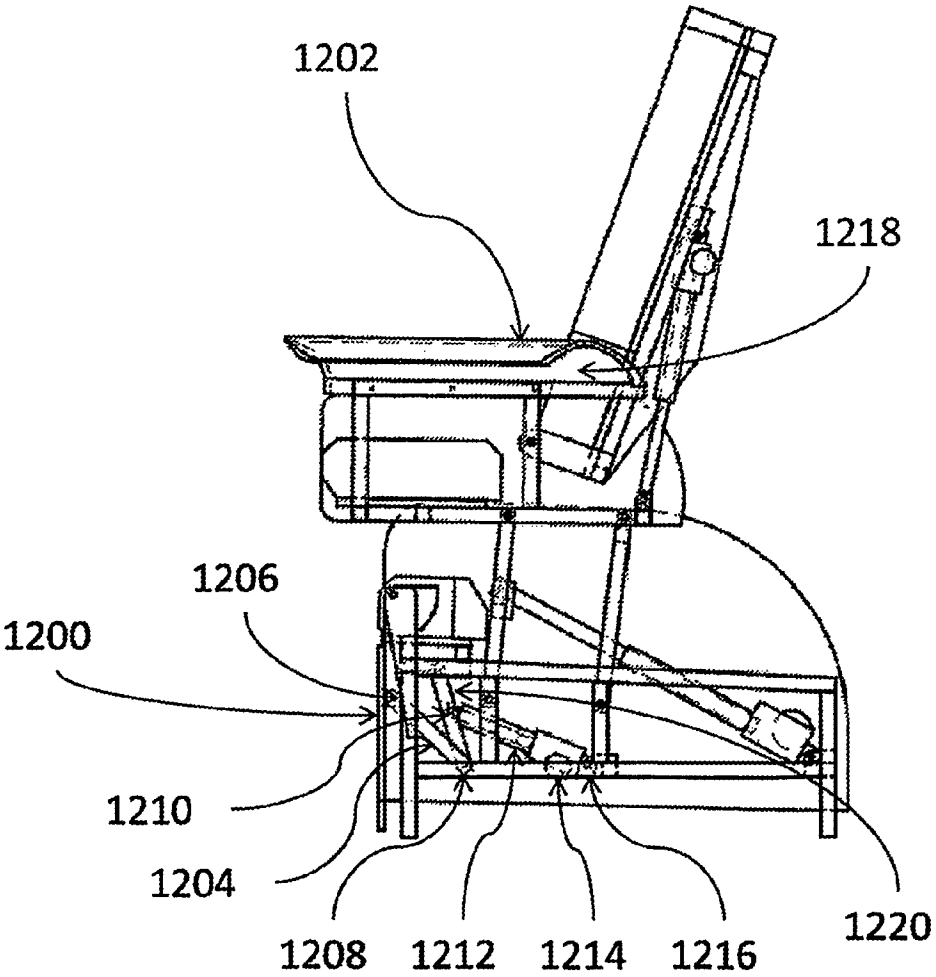
FIG. 12 is a side elevation view of an exemplary lift chair in a raised position with a hollowed armrest and an electric footrest.

FIG. 12 shows one embodiment of an electrical footrest mechanism on an exemplary lift chair. The exemplary lift chair is shown in the raised position for convenience. The footrest surface (1200) is perpendicular to the floor when stored. The footrest surface (1200) is attached at an upper end by a pivot joint (1206) to a first rest lift bar (1204). The first rest lift bar (1204) is attached by a pivot joint (1208) to a second rest lift bar (1220). A rest push bar (1212) is attached at an upper end by a pivot joint (1210) to a near midpoint of the second rest lift bar (1220) and at lower end by a pivot joint (1216) to the stationary frame. A motor (1214) attached near a lower end of the rest push bar (1212) is operable to cause the rest push bar (1212) to extend in length. As the rest push bar (1212) is extended, it pushes the second rest lift bar forward and upward, causing the first rest lift bar (1204) to pivot forward and upward, causing the footrest surface (1200) to pivot forward and upward about the pivot joint (1221). FIG. 11 shows the footrest surface (1200) in an extended position, with the rest push bar (1212) fully extended, and the footrest surface (1200) substantially parallel to the floor.

Figure 3:
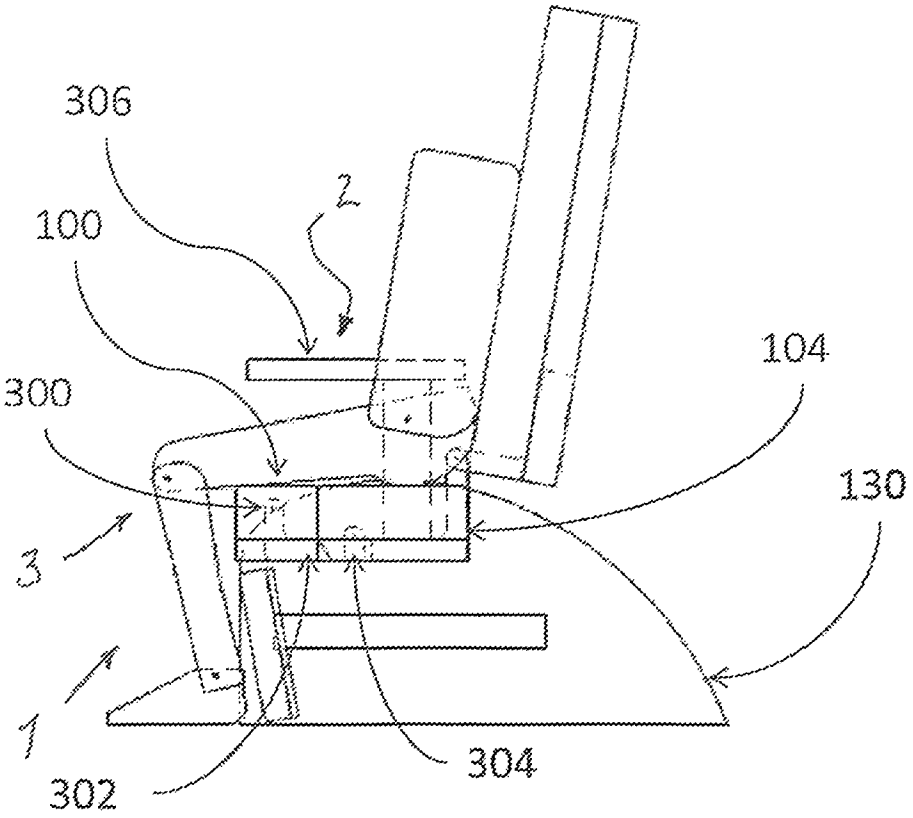
FIG. 3 is a side elevation view of an alternative exemplary lift chair with internal mechanisms exposed and a movable portion in the lowered or first position.
Figure 4:
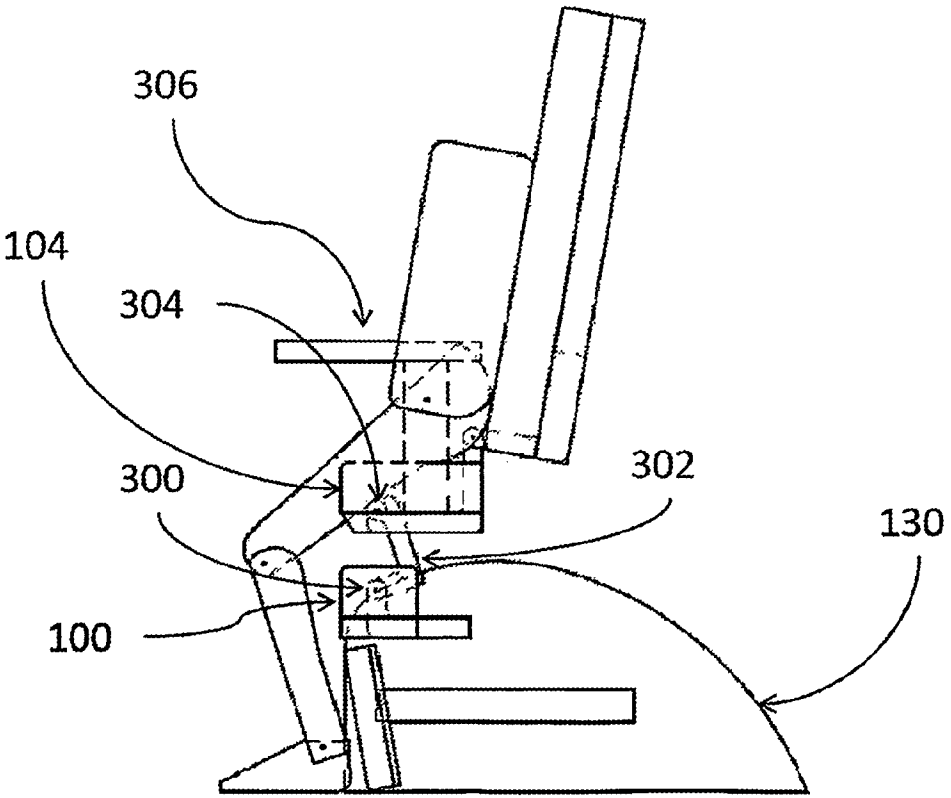
FIG. 4 is a side elevation view of an alternative exemplary lift chair with internal mechanisms exposed and a movable portion in the raised or second position.

The four-bar system shown in FIG. 1 and FIG. 2 is not the sole design for lifting the movable seat portion (104) while maintaining the movable seat portion (104) substantially parallel to the floor as it moves from the lowered (or first) position to the raised (or second) position. FIG. 3 shows an alternate embodiment for such a mechanism (3) with the movable seat portion (104) in the lowered position. An L hinge (302) is fastened to the stationary frame (130) near the stationary seat portion (100) by a pivot joint (300). For clarity, the L hinge (302) may be described as having a first branch and a second branch where the first and second branch are substantially at a right angle to each other. In this exemplary embodiment, the L hinge (302) is coupled to the stationary frame (130) at the end of the first branch of the L hinge (302). The end of a branch (whether first or second) is the location opposite where the first and second branch intersect and form the right angle. The L hinge (302) is fastened to the movable seat (104) at the end of the second branch by a pivot joint (304). A push rod and motor fastened to the stationary frame (130) below the pivot joint (304) could be extended to push the L hinge (302) upward and cause it to pivot around a pivot joint (300) and raise the movable seat portion (104) to a position shown in FIG. 4. The push rod and motor would be coupled similar to the push rod and motor described with reference to FIGS. 1 and 2, and not shown in FIGS. 3 and 4. In FIG. 4, the movable seat portion (104) is raised but remains parallel to the floor as it pivots about pivot joint 304 while it is moved between the lowered and raised positions. The second branch of the L hinge (302) has pivoted from being nearly parallel to the floor to being nearly perpendicular to the floor and the first branch of the L hinge (302) has pivoted from being nearly perpendicular to the floor to nearly parallel with the floor. One embodiment of the L hinge (302) mechanism could have a dual L hinge (302), arranged inline, for potentially increased strength and stability. Other embodiments could have three or more L hinges (302) arranged inline in order to reach the desired mechanism strength and stability. The mechanism (3) shown in FIGS. 3 and 4 is structurally associated with another means for lifting the movable portion (2).

As the L hinge (302) rotates between the lowered and raised positions, the armrest (306) travels upward with the movable seat portion (104) and provides stability while in motion. Movable armrests (306) may be used with the embodiments shown in FIGS. 1 and 2. The armrest (306) is of a shortened length that will not collide with a walker placed in front of the chair while being lifted upward and forward, but remains readily available during ingress and egress from the seat. FIG. 11 shows an alternative embodiment of an armrest design that allows for safe transition from a chair to a mobility walker or other device. The chair in FIG. 11 is in a lowered position. The armrest (1202) curves outwards from where it attaches to the movable seat portion, leaving a hollowed portion (1218) underneath. The curve of the armrest (1202) allows it to rest atop the structure of the chair while in the lowered position, with the structure of the chair fitting the hollowed portion (1218).

FIG. 12 shows the armrest (1202) of FIG. 11 with the chair in a raised position. The armrest (1202) has raised with the movable seat portion. The armrest (1202) still provides support to an occupant while in the raised position, and a mobility walker or other device can be brought close enough to the chair that its grips can be partially placed within the curved hollowed portion (1218) under the armrest (1202). With the armrest (1202) partially overlapping a mobility walker grip placed in the hollowed portion (1218), a safe transition of the occupant's hands from armrest (1202) to mobility walker can be achieved.

Figure 5:
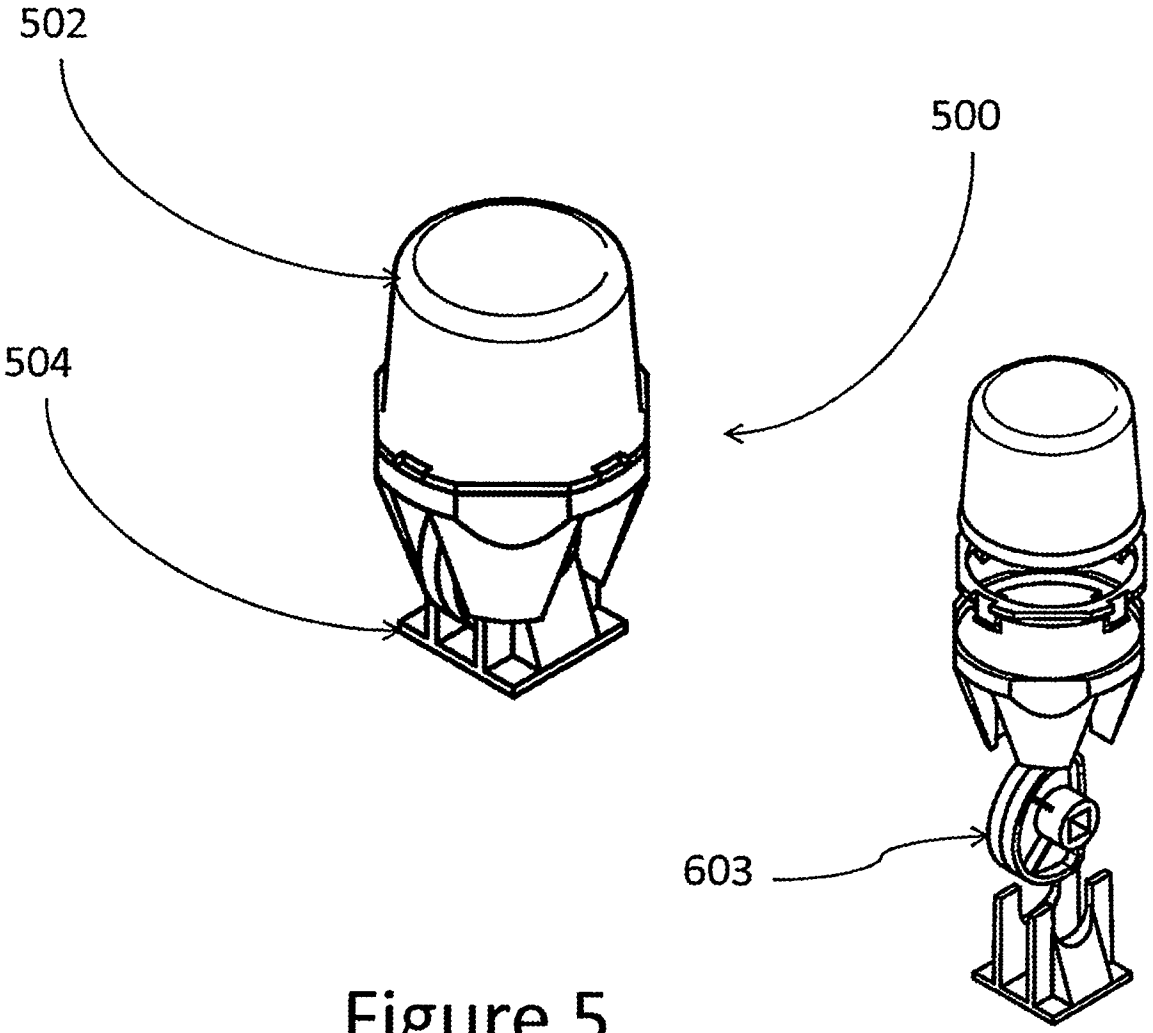
FIG. 5 is a front perspective view of an exemplary gel cushion cylinder.
Figure 6:
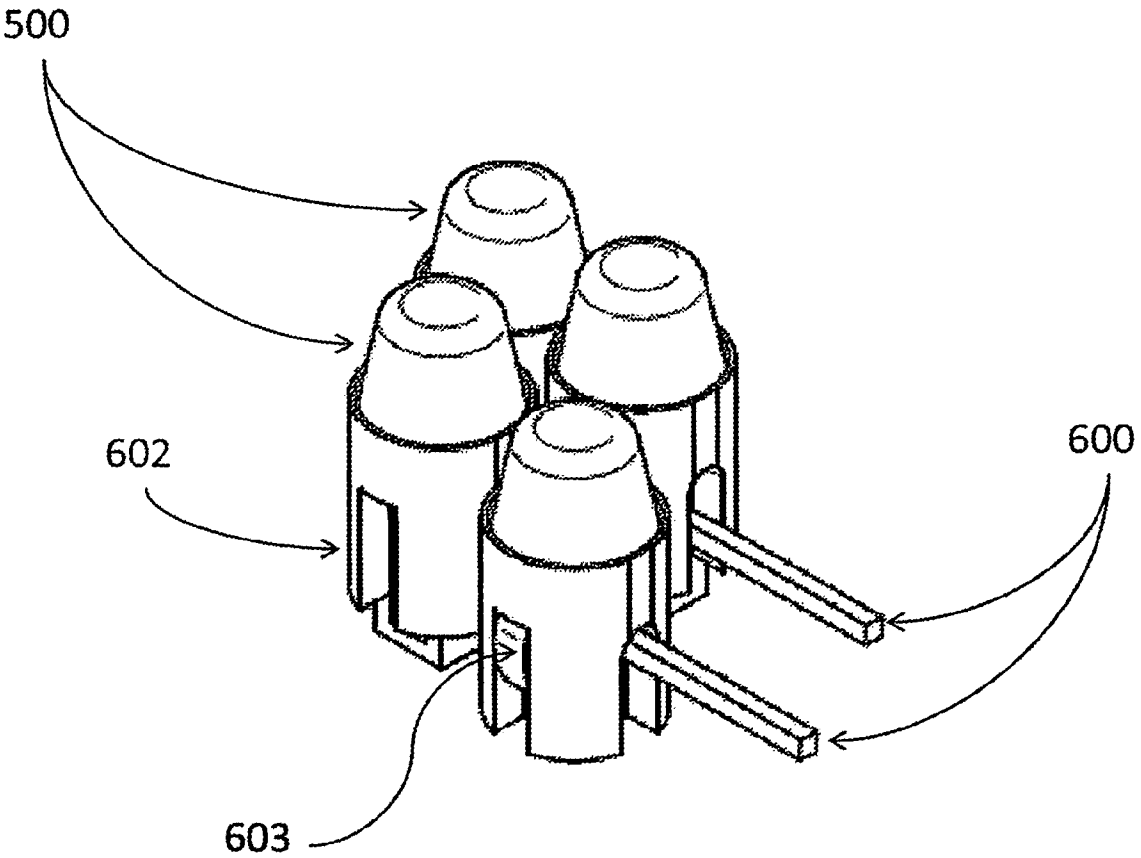
FIG. 6 is a front perspective view of a plurality of exemplary gel cushion cylinders linked together by connecting rods.

Turning now to FIG. 5, an exemplary gel cushion cylinder (500) is illustrated. The gel cushion cylinder (500) as depicted has a head portion (502). While shown as conical in the exemplary embodiment, the head portion (502) can be conical, cylindrical, or any other shape desired. The head portion (502) is attached to a base portion (504). The head portion (502) is pliable under pressure. The base portion (504) provides a rigid base to stabilize the pliable head portion (502) as it is displaced. FIG. 6 shows four gel cushion cylinders (500) interconnected in a grid. A cylinder housing (602) encases a gel cushion cylinder (500) and allows it to ascend and descend within the cylinder housing (602). A link bar (600) passes through one or more gel cushion cylinders (500), linking them together into a group. The cam (603), which may rotate by the link bar (600), may cause ascending and descending of the cylinder housing (602), causing the gel cushion cylinders (500) to ascend and descend.

Figure 7:
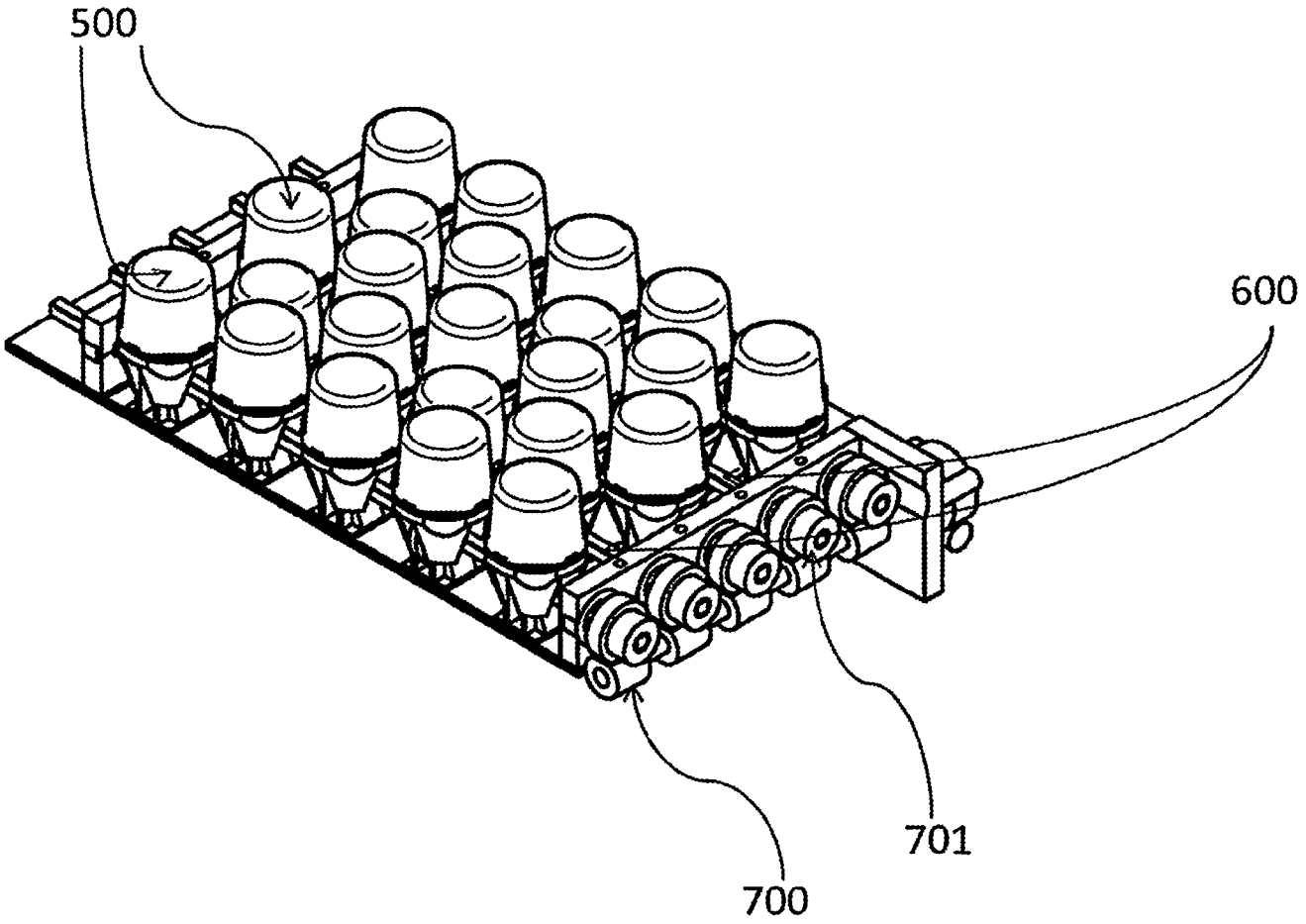
FIG. 7 is a front perspective view of an exemplary grid of gel cushion cylinders placed atop 5 link bars.

FIG. 7 shows a plurality of gel cushion cylinders (500) arranged into a seating surface-sized grid with a mechanism operable to cause groups of the cylinder cushions to ascend and descend. A plurality of link bars (600) underlie the gel cushion cylinders (500), linking them together into groups. The link bars (600) terminate with a worm gear (701) that engages a worm screw (700) rotating drive. The link bar will rotate each cam in 90-degree increments.

Figure 8:
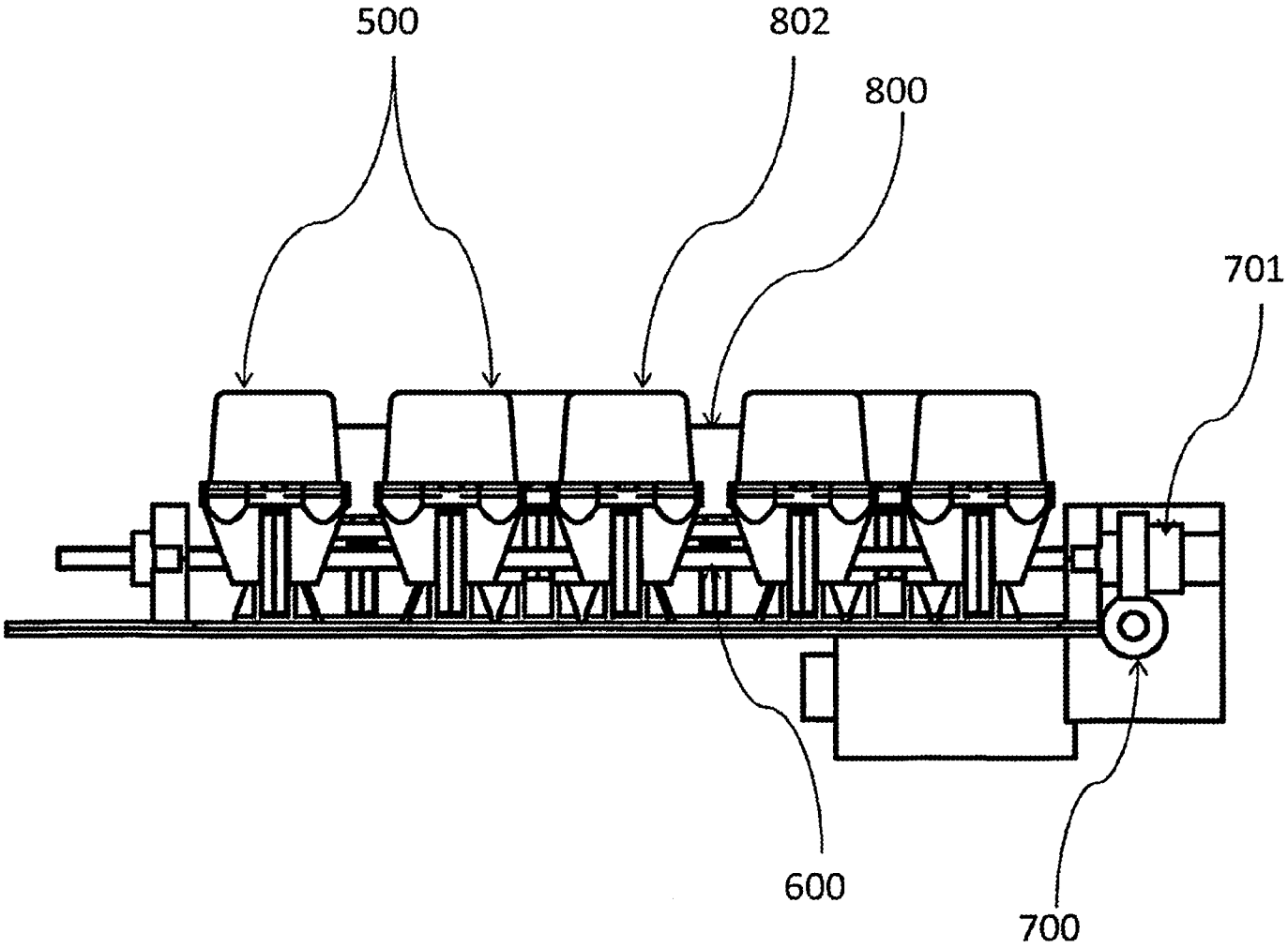
FIG. 8 is a front elevation view of an exemplary grid of gel cushion cylinders placed atop 5 link bars.
Figure 9:
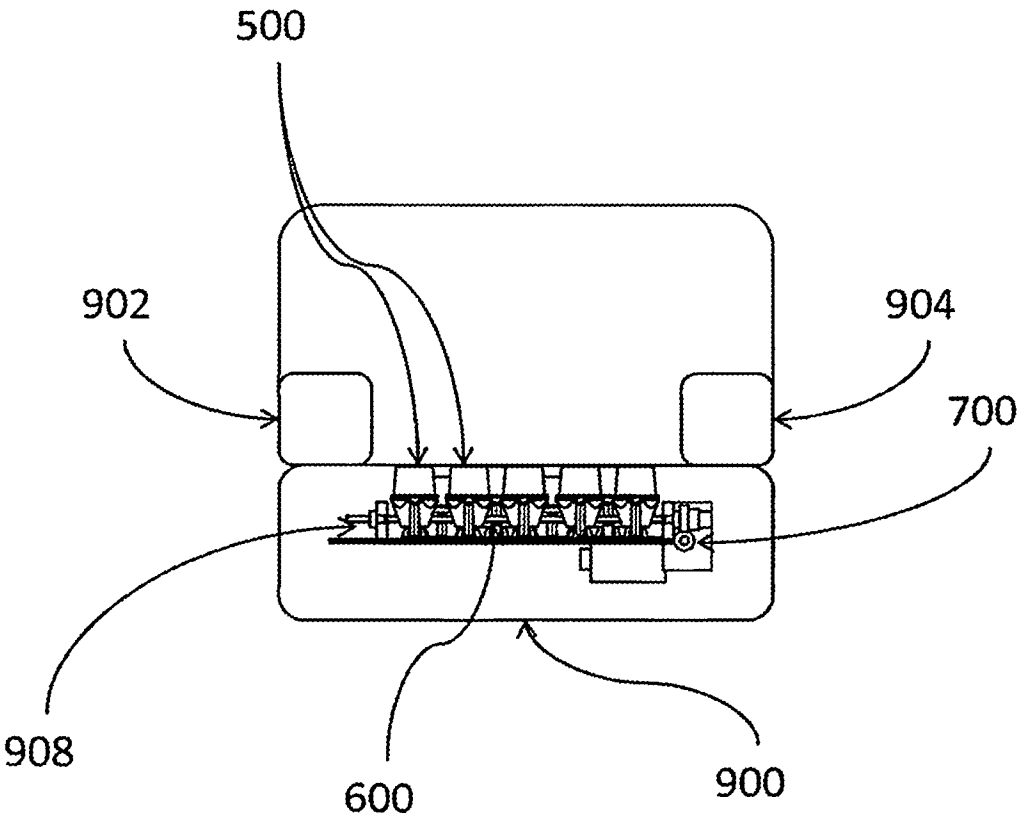
FIG. 9 is a front elevation view of an exemplary chair with a gel cushion cylinder seating surface.
Figure 10:
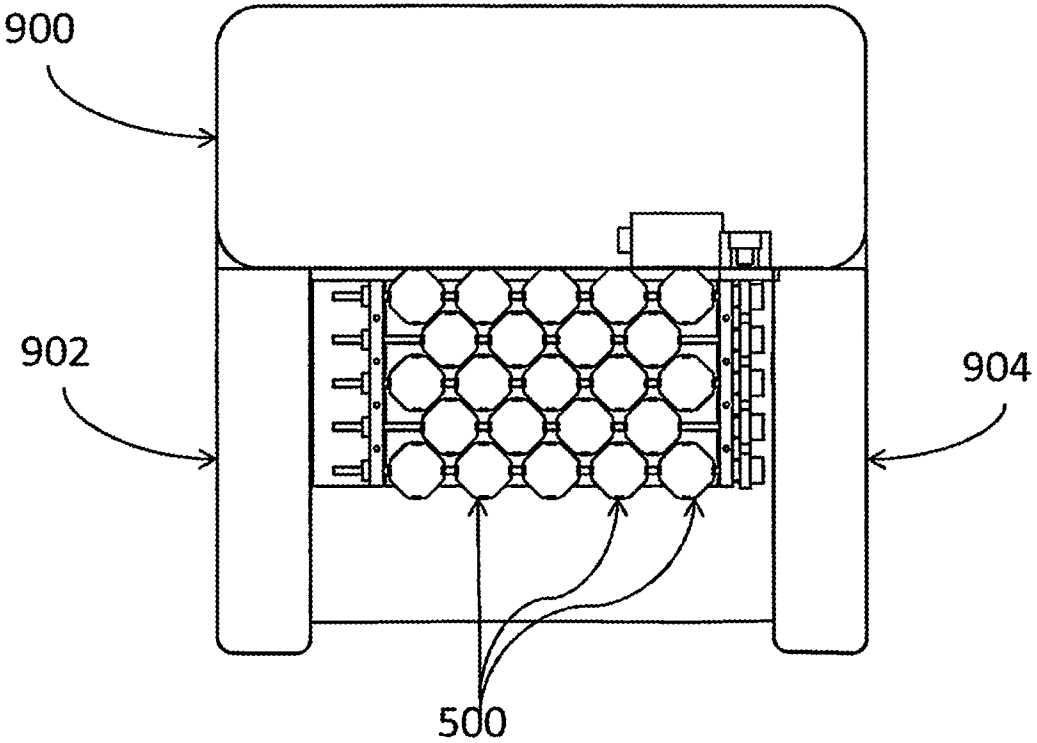
FIG. 10 is a top plan view of an exemplary chair with a gel cushion cylinder seating surface.

FIG. 8 shows a front elevation view of a plurality of gel cushion cylinders (500) linked into groups by a plurality of link bars (600) with each end terminating with a worm gear (701). FIG. 9 shows a front elevation view of an exemplary chair (900) with an exemplary seating surface (908) installed between a first armrest (902) and a second armrest (904). Gel cushion cylinders (500) that are in a raised position are at a similar elevation level as the seating surface, while gel cushion cylinders (500) that are in a lowered position sit below the level of the seating surface. FIG. 10 shows a top plan view of an exemplary lift chair (900) with a plurality of gel cushion cylinders (500) arranged in a grid to form a seating surface.

In one embodiment of the exemplary seating surface (908), a cover is installed over the gel cushion cylinders (500). The cover provides a protective layer between the mechanism and an occupant, hiding the mechanism and protecting it from dirt and other objects, and also provides a more aesthetically pleasing exterior design. In another embodiment of the exemplary seating surface (908), a friction reduction layer is installed over the gel cushion cylinders (500). A friction reduction layer made of a material with a low coefficient of friction such as parachute fabric or a silicone coated fabric reduces the heat and sound generated by the gel cushion cylinders (500) as they ascend and descend within the exemplary seating surface (908).

In some embodiments, the worm gears (701) and worm screws (700) will be operable by a controller such that an occupant can turn the system off or on and increase or decrease speed. This controller could have additional functions depending on a particular chair, such as activating heat elements or activating a chair lift. The exemplary seating surface (908) shown in FIG. 9 could in some embodiments be a modular seat cover rather than a permanently integrated seating surface. A modular seat cover could be easily removed for cleaning and maintenance and could also be installed atop a variety of seating surfaces. Other methods of causing the gel cushion cylinders (500) to ascend and descend are also possible.

In various embodiments, the groups of gel cushion cylinders (500) move in a cyclical pattern with a period (cycle time) of several minutes or more. In some such embodiments, while the cylinder movement is turned on, the cylinders rotate continuously, yielding a gradual change from one effective height pattern to another. In others, the cylinders move a portion of a cycle at regular (or irregular) intervals, yielding a more noticeable transition between height configurations. In some embodiments, the user can control the speed of the changes (or, equivalently, the cycle time), and in some embodiments the user can control the relative motions of different groups of cylinders.

Although the word "cylinders" has been used throughout to identify gel cushion cylinders (500), their actual structure in various embodiments takes a variety of forms. Some are, indeed, right circular cylinders, while others are substantially cubic, conical, frustoconical, pyramidal, or otherwise shaped as will occur to those skilled in the art in view of this disclosure.

Further variations on, features for, and applications of the inventors' technology will be immediately apparent to, and could be practiced without undue experimentation by, those of ordinary skill in the art in light of this disclosure.

The invention claimed is:

1. A piece of furniture comprising:
- a stationary section;
- a movable section; and
- a mechanism operatively coupling the stationary section and the movable section,
- the stationary section comprising:
  - a stationary seat portion including at least a first foam cushion that forms a portion of a planar seating surface;
- the movable section comprising:
  - at least one seat bar having a front end and a back end; and
  - at least one movable seat portion including at least a second foam cushion that forms another portion of the planar seating surface coupled to the front end of the at least one seat bar, wherein the at least one movable seat portion is rotationally movable between a lowered position and a forward, raised position, wherein in the lowered position the first foam cushion of the at least one movable seat portion together with the second foam cushion of the stationary seat portion form the planar seating surface and in the forward, raised position the second foam cushion of the at least one movable seat portion has overlapped at least a portion of the first foam cushion of the stationary seat portion such that an occupant transitions between a seated and a standing position;
- the mechanism comprising:
  - at least one lift bar pivotally coupled to the stationary section and the at least one seat bar;
  - a push bar pivotally, operatively coupled to at least one of the at least one seat bar or the at least one lift bar; and
  - a motor coupled to the push bar, wherein
- the motor moves the push bar between a first position and a second position such that the lift bar and the seat bar rotate between the lowered position and the raised position while the stationary seat portion remains stationary.

2. The piece of furniture of claim 1 wherein the at least one lift bar comprises a first lift bar and a second lift bar, wherein the first lift bar is pivotally coupled to the at least one seat bar towards the front end of the at least one seat bar and the second lift bar is pivotally coupled to the at least one seat bar towards the back end of the at least one seat bar.

3. The piece of furniture of claim 2 wherein the first lift bar comprises a left first lift bar and a right first lift bar, the second lift bar comprises a left second lift bar and a right second lift bar, at least one connecting bar couples the left and right first lift bar, and the push bar is pivotally coupled to the at least one connecting bar.

4. The piece of furniture of claim 1 wherein the movable section comprises a backrest coupled to the back end of the at least one seat bar wherein the backrest extends vertically from the at least one seat bar.

5. The piece of furniture of claim 1 wherein the at least one movable seat portion is configured to be substantially parallel with a floor in the lowered position and the raised position.

6. The piece of furniture of claim 5 wherein the at least one movable seat portion remains substantially parallel with the floor as it rotates up and forward or down and backward between the lowered position and the raised position.

7. The piece of furniture of claim 1 further comprising a controller operatively coupled to the motor, wherein the controller is configured to operate the motor in a first direction to move the movable section from the first position to the second position and to operate the motor in a second direction to move the movable section from the second position to the first position.

8. The piece of furniture of claim 1 further comprising a foot rest that is movable between a horizontal position and a vertical position and operatively coupled to the stationary section.

9. The piece of furniture of claim 8 further comprising a controller operatively coupled to the motor, wherein the controller is configured to operate the motor in a first direction to move the movable section from the first position to the second position and to operate the motor in a second direction to move the movable section from the second position to the first position and, wherein the controller is further configured to move the foot rest between the horizontal position and vertical position.

10. The piece of furniture of claim 1 wherein the movable section further comprises a pair of arm rests operatively coupled to the at least one seat bar and movable between the lowered position and the raised position.

11. The piece of furniture of claim 1 further comprising a pair of armrests operatively coupled to the movable section.

12. The piece of furniture of claim 11 wherein at least one of the armrests comprises a hollowed portion.

13. The piece of furniture of claim 1 wherein the piece of furniture is a chair.

14. A chair comprising:

a stationary section;

a movable section; and means for lifting the moveable section with respect to the stationary section, the stationary section comprising:

a stationary seat portion comprising a first foam cushion;

the movable section comprising:

at least one seat bar having a front end and a back end;

at least one movable seat portion comprising a second foam cushion coupled to the front end of the at least one seat bar, wherein the at least one movable seat portion is movable between a rearward, lowered position and a forward, raised position, where when the movable seat portion is in the lowered position the first foam cushion forms a planar seating surface with the second foam cushion and in the forward, raised position the second foam cushion overlaps at least a part of the first foam cushion to facilitate an occupant transitioning between seated and standing; and at least one backrest coupled to the back end of the at least one seat bar, wherein the means for lifting causes the at least one seat bar to move between a first position and a second position such that the seat bar rotates between the lowered position and the raised position while the stationary seat portion remains stationary and the movable seat portion remains substantially parallel with a floor.

15. A piece of furniture, comprising a stationary seat portion including at least a first foam cushion;

a movable seat portion including at least a second foam cushion; and a parallelogram linkage mechanism operatively coupling the stationary seat portion and the movable seat portion to move the movable seat portion between a lowered position and a raised position wherein the first foam cushion and the second foam cushion together form a planar seating surface when in the lowered position, wherein, as the parallelogram linkage mechanism rotates the movable portion including the second foam cushion from the lowered position upward and forward to an upward and forward raised position to facilitate transitioning an occupant from a seated position to a standing position and from the upward and forward raised position to the lowered position to facilitate transitioning the occupant from the standing position to the seated position, the movable portion remains substantially parallel to a floor, and the stationary seat portion remains substantially stationary.

* * * * *